United States Patent [19]

Jaworski

[11] Patent Number: 4,502,168

[45] **Date of Patent: *Mar. 5, 1985**

[54] HYDROTHERAPY JET FOR TUBS, SPAS OR POOLS

[75] Inventor: William R. Jaworski, Minneapolis, Minn.

[73] Assignee: Jope Manufacturing Co., Inc., Minneapolis, Minn.

[*] Notice: The portion of the term of this patent subsequent to Dec. 27, 2000, has been disclaimed.

[21] Appl. No.: 541,094

[22] Filed: Oct. 12, 1983

Related U.S. Application Data

[63] Continuation-in-part of Ser. No. 427,847, Sep. 29, 1982, Pat. No. 4,422,191.

[51] Int. Cl.[3] ..... A04H 3/18; A61H 33/02; E03C 1/02

[52] U.S. Cl. ..... 4/496; 4/541; 4/542; 4/492; 128/66; 239/428.5

[58] Field of Search ..... 4/496, 541, 542, 492, 4/490, 543; 128/66; 239/428, 428.5

[56] References Cited

U.S. PATENT DOCUMENTS

| | | | |
|---|---|---|---|
| 3,541,616 | 11/1970 | Stricker | 4/542 |
| 3,745,994 | 7/1973 | Kane | 128/66 |
| 3,905,358 | 9/1975 | Jacuzzi | 128/66 |
| 3,985,303 | 10/1976 | Steimle | 128/66 X |
| 4,082,091 | 4/1978 | Kaab | 4/559 X |
| 4,261,347 | 4/1981 | Spencer et al. | 239/428.5 X |
| 4,262,371 | 4/1981 | Berry et al. | 4/492 X |

*Primary Examiner*—Henry K. Artis
*Attorney, Agent, or Firm*—James V. Harmon

[57] ABSTRACT

A hydrotherapy jet is described in which a nozzle is mounted for universal swiveling motion so that it can be positioned to direct a stream of water and air in any selected direction. Water and air enter through pipes positioned at right angles to one another, the water inlet pipe is positioned at right angles to the center axis of the hydrotherapy jet and nozzle axis. The air inlet pipe is aligned with the hydrotherapy jet axis and the nozzle axis so that the hydrotherapy jet can be rotated on its own central axis within an opening in a tub wall to facilitate the plumbing in the connection of water supply pipes without changing the position of the air supply pipe.

7 Claims, 5 Drawing Figures

HYDROTHERAPY JET FOR TUBS, SPAS OR POOLS

This application is a continuation-in-part of my prior copending patent application Ser. No. 427,847 filed Sept. 29, 1982, now U.S. Pat. No. 4,422,191.

FIELD OF THE INVENTION

This invention relates to jets used in pools, spas, tubs and the like for hydromassage or hydrotherapy in which an air induction system is provided for introducing air into a pressurized water stream.

THE PRIOR ART

The increasing use of hydrotherapy or hydromassage jets in tubs, spas and pools in recent years has resulted largely from a greater interest in the recreational and therapeutic use of tubs and spas particularly in the home. Several hydrotherapy jets have been in commercial use.

Prior jets have certain difficulties associated with installation and plumbing. This has two causes. First, many prior units cannot be made compact in design, so that the housing protrudes a substantial distance, often six or eight inches outwardly from the outside surface of the tub after installation. As a result, a large clearance space must be allowed around the outside of the tub. Another cause for problems is the necessity in many prior jets of spacing the water feed pipe a substantial distance away from the tub wall at the point where it connects to the jet housing. This requires even more space around the tub for installation. Thus, most prior hydrotherapy jets are not well suited for installation in a small space. Installation is also time consuming. Another problem is the interdependence of air and water feed pipe positions so that when the position and orientation is selected for the water pipe it may turn out to be a bad angle for connecting the air supply pipe. This results from the fact that a change in position of the water inlet duct will also change the position of the air inlet duct.

U.S. Pat. No. 3,471,091 describes a hydrotherapy fitting for a tub or spa with a housing in which a nozzle is universally mounted. The nozzle is provided with a throat of reduced diameter. An air tube includes an air port located at the center axis of the nozzle and spaced axially from the throat of the nozzle. Both the water inlet duct and the air inlet duct are perpendicular to the wall of the tub upon which the unit is mounted.

U.S. Pat. No. 3,905,358 describes another hydrotherapy jet including an air tube with a port at the center axis of an axial flow passage within a movable nozzle. The passage in the nozzle also has a reduced diameter throat spaced axially from the port. In this case, the water supply duct is perpendicular to the wall of the pool or tub and the air tube is parallel to it. In both of these units, because water enters in alignment with the axis of the nozzle, i.e. normal to the tub surface, either a T joint or an elbow must be provided to connect the incoming water supply pipe.

In a hydrotherapy jet, water is usually supplied under pressure from a pump driven by an electric motor. An aspiration arrangement is provided within the jet to incorporate air into the water stream. The presence of sufficient air as bubbles of the proper size is important in obtaining an effective body message as well as the subjective feel of pressure as judged by placing the hand a predetermined distance from the jet. Thus, if the air supply is cut off, the body message effect and the feel of pressure against the hand exerted by the emerging water stream drops drastically. In a typical test, the hand is placed in the water 12 inches from the jet nozzle with the jet in normal operation. When the air supply is cut off, the apparent pressure exerted against the hand appears to be only a small fraction, say $\frac{1}{3}$ to $\frac{1}{4}$ of what it was originally. This demonstrates the importance of efficiently introducing air into the water stream to obtain a maximum massaging effect.

SUMMARY OF THE INVENTION

In accordance with the invention, a hydrotherapy jet is provided with a water inlet and an air inlet adapted to supply water and air streams to the interior of the jet. The jet includes a housing with a movable nozzle having a passage extending through it for water and air streams. The nozzle is universally supported within a ball socket located in the housing.

Means is provided at the inlet end of the nozzle for producing a central wall stream aligned axially with the passage in the nozzle and flowing toward it. During operation, the air stream becomes incorporated into the water stream. This action assures the entrainment of air in the water stream expelled through the nozzle.

The jet body of housing has a water inlet duct which in accordance with the present invention is positioned parallel to the plane of the tub wall when the jet is installed, i.e. perpendicular to the center axis of the nozzle. Mounted within a ball socket is an eyeball or ball portion of the nozzle. The socket communicates with the inlet duct so that water will flow from the inlet duct through the nozzle mounted in the socket.

The air inlet duct is located in alignment with the center axis of the nozzle, i.e. perpendicular to the tub wall while the water supply pipe and water inlet duct are positioned perpendicular to the air supply duct.

The hydrotherapy jet also includes a nozzle containment chamber that is open to the interior of the tub or spa. At the center of this chamber is located the ball socket which holds the nozzle. The containment chamber encloses the nozzle and provides an outlet for the high velocity jet of water and air expelled through the nozzle. The chamber includes a side wall that is closed upon itself and is spaced radially from the center axis of the nozzle. The side wall terminates in an open rim that serves as a mounting surface adapted to be secured to the wall of the tub or spa. The chamber also includes an end wall in which a ball socket is located. The water inlet duct is parallel to the mounting surface and adjacent to the end wall of the containment chamber.

DETAILED DESCRIPTION

Figure 1:
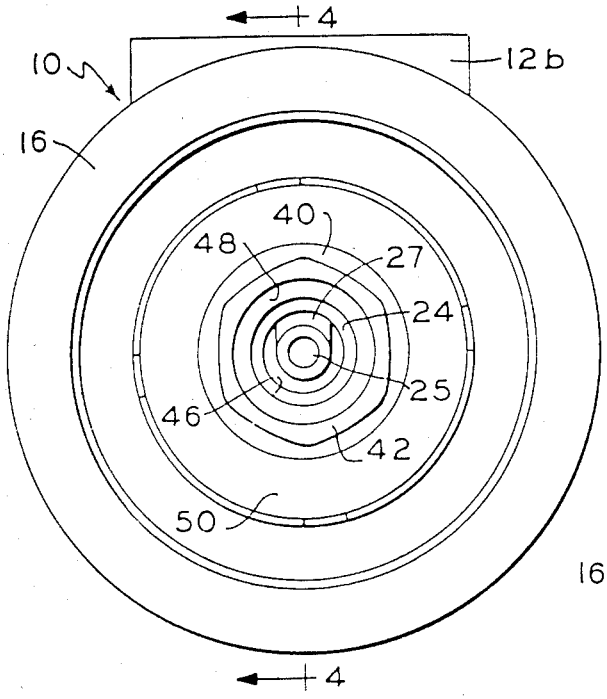
FIG. 1 is a front elevational view of a hydrotherapy jet in accordance with the invention.

As shown in the figures, a hydrotherapy unit is provided including a housing or jet body 10 composed of three major components, a water inlet duct 12, a nozzle containment chamber 18 and an intermediate chamber 22 between them that serves as a water passage allowing water to flow from the water inlet duct 12 to a nozzle 40 mounted within the chamber 18. The hydrotherapy jet can be formed from a variety of materials. Thermoplastic resinous materials such as polyvinyl chloride or ABS resin are preferred.

The water inlet duct 12 includes an upper circular mouth 12*a* and an outer cylindrical surface 12*b*. Into the open end of the mouth 12*a* is slip fitted a section of water feed pipe (not shown) such as plastic pipe which is held in place by well-known solvent .welding techniques. In the duct 12 is a reduced bore 14 forming a shoulder to locate he end of the supply pipe. Adjacent water inlet duct 12 is an air inlet 15 which is provided with an enlarged mouth at 26 aligned with the axis of chamber 18 and nozzle 40 for the insertion of an air supply pipe (not shown).

The nozzle containment chamber 18 includes a side wall 18*c* that is closed upon itself and in this case is cylindrical in shape. Chamber 18 has a radially projecting circular rim that serves as a tub mounting flange 18*a* including an outer flat surface 16 which engages the outer surface of tube wall 21. The tub wall 21 is provided with a bored opening through which extends a retaining collar 19 that is screwthreaded at 19*a* into the cylindrical wall 18*c* to hold the jet housing 10 in place on the tub 21 as shown in FIG. 4. A suitable adhesive or sealing gasket (not shown) can be used between the tub wall and the hydrotherapy unit as desired. The collar 19 is ring-shaped and includes a large central opening 19*b* for the nozzle 40 to be described below. Chamber 18 has a flat end wall 18*b* wih an axial projection 20 (FIGS. 2–4) for a ball retaining ring to be described below.

Figure 2:
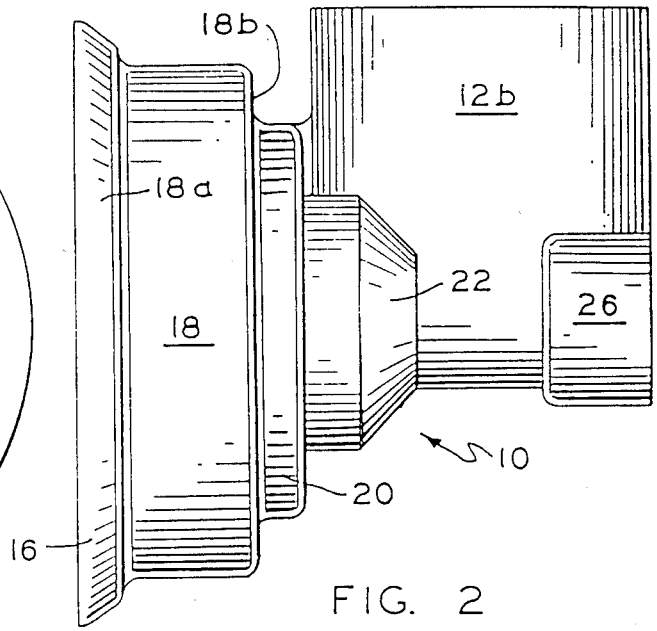
FIG. 2 is a side elevational view of the jet of FIG. 1.

The intermediate chamber 22 communicates at its left end as seen in FIGS. 2 and 4 with the nozzle 40 to be described below and its other end with the interior of the water duct 12. In this way, water passes from the inlet duct 12 to the nozzle 40.

Centered within the chamber 22 are two concentric tubes including an outer tube 24 and an inner tube 25 spaced inwardly therefrom to form an annular air duct 15*a* between them. The air duct 15*a* communicates with the air inlet 15. It can be seen that the two concentric ducts 24 and 25 extend from their free ends away from the nozzle 40 toward the right and are integral with the walls of the housing of the hydrotherapy jet 10.

Figure 3:
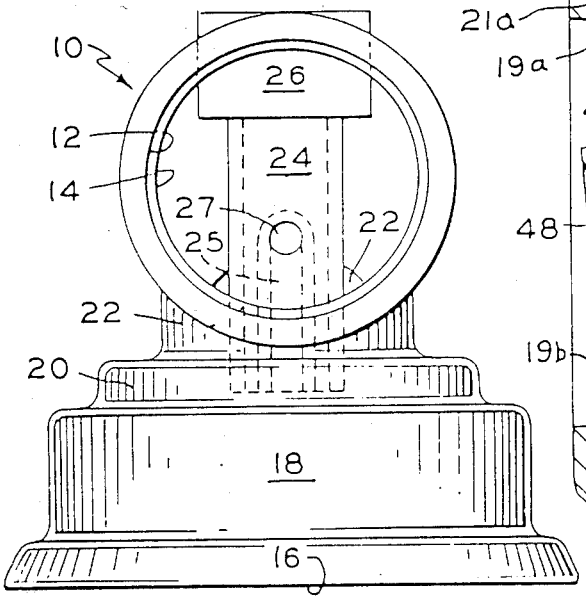
FIG. 3 is a top view of the jet.
Figure 4:
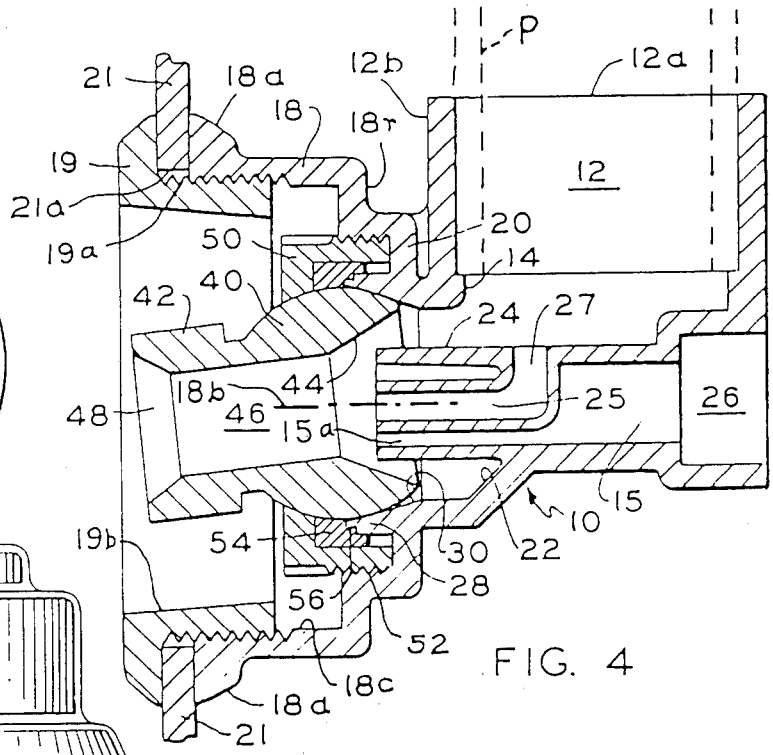
FIG. 4 is a vertical sectional view taken on line 4—4 of FIG. 1.
Figure 5:
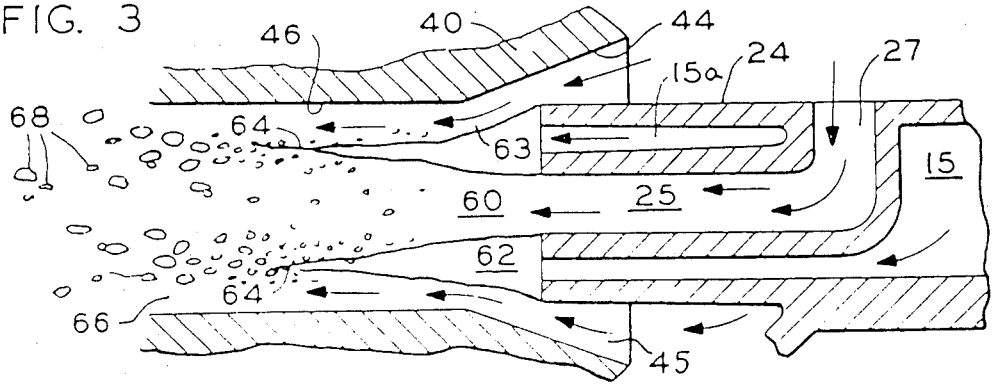
FIG. 5 is a partly diagramatic enlarged view of the nozzle and inlet ducts adjacent to it to show the operation of the invention.

As seen in FIGS. 3–5, the inner pipe 25 bends upwardly at the end thereof most distant from the nozzle 40 and communicates through an opening 27 with the interior of the water inlet duct 12. In this way, the water from the duct 12 flows through the opening 27 into pipe 25 to form a central water vortex. While the hole 27 can be positioned to one side, it is preferred that it point in the direction of the stream of water entering duct 12. This helps to funnel water into pipe 25.

Centrally located within the end wall 18*b* of the nozzle chamber 18 is a generally conical ball socket tapered outwardly in the direction of the nozzle containment chamber 18 and having its smallest cross-sectional diameter at the junction with the chamber 22. Universally supported within the socket 30 is a nozzle having an eyeball 40 of spherical configuration with an outward extension 42 at its free end, i.e. the left end as seen in FIG. 4 which serves as a positioning knob, and a central passage 46 of cylindrical shape having an inlet at its right end in the figures communicating with the water inlet duct 12. The inlet can comprise an inlet cone or funnel 44 to help guide the flow of the fluid into passage 46. At the other end of the passage 46 is an outlet 48 which if desired may have a beveled edge defining a conical outlet opening 48.

The nozzle or eyeball 40 is held for universal swiveling motion within the socket 30 by means of a ball retaining ring 50 that is screwthreaded into the rearward projection 20 of the rear wall 18*b* of chamber 18 as shown at 52. Between the eyeball 40 and the socket 30 is a sealing gasket 54 that is held in place by the retaining ring 50. When ring 50 is tightened, the inner surface of the gasket 54 is forced onto a relatively sharp circular edge 56 at the large end of the socket 30 to help assure a good seal.

It will be noted that the nozzle 40 is positioned at the center of chamber 18 and has a center point that is in alignment with the central axis of tubes 24 and 25. The nozzle itself has a center axis which is in alignment with the axis of tubes 24, 25 when the nozzle itself is straight or centered, i.e. aligned with the center axis of the chamber 18 as shown in FIG. 5. During use, it will be apparent that the nozzle 40 can be swiveled in any direction desired. In FIG. 4, it is shown at an inclined position in which it will direct water downwardly at a small angle. When the axis of the nozzle 40 is referred to herein, it will have reference to the centered position in FIG. 5. It will be noted that the free outlet ends of tubes 24 and 25, i.e. their left ends as shown in FIGS. 4 and 5, terminate in alignment with each other and are spaced from the nozzle 40. In the embodiment shown, tubes 24 and 25 project a slight distance inside the nozzle 40. The inlet or cone 44 is larger in diameter than the free end of the tube 24 thereby defining an annular mouth 45 between the outside surface of tube 24 and the inlet 44 for conducting a portion of the water entering through duct 12 into the inlet 44 of the nozzle 40. This difference in size permits the ball 40 to be swiveled in all directions without striking the tube 24.

The operation of the hydrotherapy jet will now be described in connection with FIG. 5.

To use the hydrotherapy jet, a round opening 21*a* of the appropriate size is first bored in the wall 21 of the tub, pool or spa to receive the collar 19. The unit is then placed in the opening 21*a* as shown in FIG. 4 and the water inlet 12 is directed upwardly, downwardly or to one side, i.e. at any angle with respect to the center axis 18*b* of the chamber 18 which is the same as the axis of the opening in the tub 21. Because duct 12 can be pointed in any direction extending radially of the axis 18*b* of chamber 18 and the hole 21*a*, the plumbing of water pipes P as well as air pipes (not shown) is substantially simplified. It will also be seen that no elbow or T fitting is required to attach the water supply pipe P into the water supply duct 12. When the direction of the water inlet has been selected and set, the collar 19 is tightened to securely retain the unit in place within the opening 21*a*. It will be seen that as the unit is rotated about axis 18*b* to its selected position, the mouth 26 of the air supply duct 15 remains in the same place. This is because the mouth of the air supply duct is aligned with the axis 18*b* of the chamber 18 and opening 21*a*. Since the air supply pipe is relatively small in size, it can be easily attached to the mouth 26 of the air duct 15 with or without an elbow. It can also be seen from FIG. 4 that the water inlet pipe P will be located relatively close to the tub wall 21 because the hydrotherapy jet in accordance with the invention is made highly compact through compression or foreshortening, i.e., by placing duct 12 adjacent the nozzle chamber 18, and by positioning the axis of the inlet duct 12 at right angles to axis 18*b* and in alignment with the rear wall 18*r* of the nozzle chamber 18 and perpendicular to the axis of the nozzle 40. The term "adjacent" means less than an inch or two. As can be seen in FIG. 4, the wall 12*b* of the inlet is only a fraction of an inch from the rear wall 18*r* of the nozzle chamber. Thus, the pipe P can be placed less than two inches from the tub wall 21. Accordingly, the protrusion of the jet from the outer wall of the tub is minimized. The overall depth may be only about 3½ inches allowing installation in a minimum of space and enabling the tubs to be used in locations where prior tubs will not fit. Shipping cartons are also reduced in size and freight costs are lowered. The air supply pipe (not shown) can be connected to the air inlet through a straight pipe or elbow and pointed in any direction. This is a big advantage because it allows the jet housing to be mounted anywhere even next to wall supports or braces and the like with the air supply pipe pointed away from the wall or other obstruction.

After the unit installed in the manner described and the supply pipes connected for water and air, water under pressure is supplied through the inlet 12.

The water under pressure is supplied by a pump (not shown) that is driven by an electric motor which is typically about 0.5 for a single jet to 3 H.P. (multiple jet) providing a jet velocity of about 50 feet per second and a line pressure of about 15–20 psi. As the water flows under pressure from pipe P into the inlet 12, it is directed toward the passage 22 in the nozzle around the outside of tube 24. It then flows at high speed through the mouth 45 between the free end of the tube 24 and the inlet cone 44 of the nozzle 40. A portion enters the opening 27 in pipe 25 and is expelled as shown in FIG. 5 as a fast moving stream or jet 60 into the passage within the nozzle 40. Accordingly, two water vortices exist concentric to one another and with air provided through annular duct 15*a* they are separated by an intermediate annular lamina of air 62. The inner surface of the outer water vortex 63 as well as the outer surface of the inner water vortex 60 are both exposed to the intermediate annular lamina of air 62 between them. This assists in efficient induction of air into the combined water stream 66 in the form of small bubbles 68 about 1/16" to ⅛" in diameter. Not long after the streams pass the free end of the concentric ducts 24, 25 they intersect, striking one another along a circular impact zone 64. As the two streams collide forcefully in the presence of the intermediate lamina of air, they become almost explosively disrupted to vigorously incorporate air from the annular air lamina between them. The nozzle can be swiveled by means of the extension 42 as its free end to any desired position up, down or to the side to direct the stream where desired.

The hydrotherapy jet of the present invention can be easily produced by injection molding using known methods. The nozzle 40 can be quickly changed to provide passages 46 of different diameters depending upon the requirements of the installation, i.e., different gallonage outputs.

If several jets are connected to a single pump, small nozzle passages are desirable to maintain the same pressure within the water piping connecting all jets.

If desired, the housing and the mounting collar 19 can be electroplated with a metal coating since there are no protrusions present that will interrupt a plated coating.

While the invention has been described by way of example, numerous variations will be apparent to those skilled in the art within the scope of the appended claims once the principles of the invention are understood.

What is claimed is:

1. A hydrotherapy jet comprising a housing including a nozzle containment chamber having a nozzle mounted movably therein, said chamber having a cylindrical side wall adapted to be mounted for rotation within a round hole in the wall of a tub, pool or spa, a water inlet duct at right angles to the axis of the chamber, and an air inlet duct having a mouth aligned with said axis of said chamber whereby the jet housing can be rotated in the hole to point the water inlet duct in any direction extending radially from said axis without changing the position of the mouth of the air inlet whereby water and air inlet positions are independent of one another so that plumbing for water is facilitated by enabling water supply pipes extending parallel to said tub wall to be connected to the water duct and to extend in any direction in a plane parallel to said tub wall without also changing the position of air pipes used for supplying air to the air inlet.

2. The hydrotherapy jet of claim 1 wherein the nozzle containment chamber includes a radially projecting circular rim that serves as a mounting flange having a flat outer surface adapted to engage said wall of the tub and a retaining collar extending into the interior of the nozzle containment chamber for securing the hydrotherapy jet within the round opening in the tub wall.

3. The apparatus of claim 2 wherein the retaining collar is screwthreaded into the interior of the nozzle containment chamber.

4. The hydrotherapy jet of claim 1 wherein the nozzle containment chamber has a rear wall extending at right angles to the cylindrical side wall and said water inlet duct is positioned adjacent to the rear wall of the nozzle containment chamber whereby the hydrotherapy nozzle is made highly compact through compression so that the close placement of the water supply pipes to the side wall of the tub is facilitated.

5. The hydrotherapy jet of claim 1 wherein the jet includes a movable nozzle supported in the housing for movement about a center point to enable the nozzle outlet to be pointed in different directions, means at the inlet end of the nozzle defining a central water stream aligned axially with the passage in the nozzle and flowing toward it, means at the inlet end of the nozzle defining an air stream flowing into the nozzle whereby the air and water streams combine to form a combination stream of water and air flowing out of said nozzle.

6. The hydrotherapy jet of claim 5 wherein said air inlet duct includes a tube positioned in alignment with the axis of said chamber and said tube includes an outer end portion defining the mouth of the air inlet duct, said mouth of the air inlet duct also being aligned with the axis of the chamber and communicating with the air inlet tube whereby both the air inlet tube and the mouth stay in the same place when the housing is rotated in the hole within the wall of the tub.

7. A hydrotherapy jet comprising a water supply duct means for conducting water into the jet, a swiveling nozzle means therein having a passage therethrough with an inlet and an outlet, the nozzle being adapted to be moved therein to selected positions, duct means defining first and second spaced apart water streams flowing into the inlet end of the passage in the swiveling nozzle, an intermediate air space is present between the water streams whereby surfaces of the water streams are both exposed to an intermediate lamina of air and while the water in the first and second streams is thus exposed to the intermediate air lamina the two streams of water converge thereby striking one another forcefully and becoming disrupted to vigorously incorporate air from the intermediate air lamina into the combined streams.

* * * * *